US007169419B2

(12) United States Patent
Dalton et al.

(10) Patent No.: US 7,169,419 B2
(45) **Date of Patent: *Jan. 30, 2007**

(54) PACKAGING SYSTEM TO PROVIDE FRESH PACKED COFFEE

(75) Inventors: David Andrew Dalton, Loveland, OH (US); Kerry Lloyd Weaver, Florence, KY (US); Thomas James Manske, Jr., Mason, OH (US)

(73) Assignee: The Procter and Gamble Company, Cincinnati, OH (US)

( * ) Notice: Subject to any disclaimer, the term of this patent is extended or adjusted under 35 U.S.C. 154(b) by 19 days.

This patent is subject to a terminal disclaimer.

(21) Appl. No.: 10/726,309

(22) Filed: Dec. 2, 2003

(65) Prior Publication Data

US 2004/0137110 A1 Jul. 15, 2004

Related U.S. Application Data

(63) Continuation-in-part of application No. 10/155,338, filed on May 24, 2002.

(60) Provisional application No. 60/295,666, filed on Jun. 4, 2001.

(51) Int. Cl.
*B65D 83/00* (2006.01)
*B65D 85/00* (2006.01)

(52) U.S. Cl. ..... 426/110; 426/118; 426/127

(58) Field of Classification Search ..... 426/110, 426/118, 127, 126, 395, 396, 398; 220/495.03, 220/227, 366.1

See application file for complete search history.

(56) References Cited

U.S. PATENT DOCUMENTS

| | | | | | |
|---|---|---|---|---|---|
| 3,944,127 | A * | 3/1976 | Bruke et al. | ..... | 206/205 |
| 4,890,752 | A * | 1/1990 | Ota et al. | ..... | 215/384 |
| 4,966,780 | A * | 10/1990 | Hargraves et al. | ..... | 426/118 |
| 5,085,034 | A * | 2/1992 | Haas | ..... | 53/452 |
| 5,160,767 | A * | 11/1992 | Genske et al. | ..... | 428/35.9 |
| 6,733,803 | B1 * | 5/2004 | Vidkjaer | ..... | 426/62 |

OTHER PUBLICATIONS

Marks' Standard Handbook for Mechanical Engineers (10th Edition). McGraw Hill (1996) [retrieved from online Aug. 18, 2004] Table 6.12.1 URL<http://www.knovel.com/knovel2/Toc.jsp?SpaceID=162&BookID=346>.*

"The Blow Molding Process". 2000. [retrieved from Internet on Aug. 10, 2004] URL<http://www.oxfordsource.com/Home/Design/Blow_Molding/blow_molding.html>.*

* cited by examiner

*Primary Examiner*—Arthur L. Corbin
(74) *Attorney, Agent, or Firm*—Ingrid N. Hackett; Carl J. Roof; Peter D. Meyer

(57) ABSTRACT

A packaging system useful for roast and ground coffee, having a container with a closed bottom, an open top, and a body enclosing a perimeter between the bottom and the top. An annular protuberance is disposed upon the body and is continuously disposed around the perimeter of the body proximate to the top. The protuberance forms a surface external to the body. The surface is substantially perpendicular to the longitudinal axis of the container. A flexible closure is removeably attached and sealed to the protuberance so that the closure seals the interior volume of the container.

18 Claims, 10 Drawing Sheets

PACKAGING SYSTEM TO PROVIDE FRESH PACKED COFFEE

CROSS REFERENCE TO PRIOR APPLICATIONS

This application is a continuation-in-part of U.S. patent application Ser. No. 10/155,338, filed on May 24, 2002 (currently pending), which claims the benefit of U.S. Provisional Application Ser. No. 60/295,666, filed Jun. 4, 2001.

FIELD OF THE INVENTION

The present invention relates to a packaging system useful for packing fresh roast and ground coffee. The present invention still further relates to a more convenient, lightweight container that provides increased strength per mass unit of plastic for the transport of freshly roast and ground coffee.

BACKGROUND OF THE INVENTION

Packages such as cylindrical cans for containing a particulate product under pressure, such as roast and ground coffee, are representative of various articles to which the present invention is applicable. It is well known in the art that freshly roasted and ground coffee evolutes substantial amounts of oils and gases, such as carbon dioxide, particularly after the roasting and grinding process. Therefore, roast and ground coffee is usually held in storage bins prior to final packing to allow for maximum off gassing of these volatile, natural products. The final coffee product is then placed into a package and subjected to a vacuum packing operation.

Vacuum packing the final coffee product results in reduced levels of oxygen in the headspace of the package. This is beneficial, as oxygen reactions are a major factor in the staling of coffee. A common package used in the industry is a cylindrical, tin-plated, and steel stock can. The coffee is first roasted, and then ground, and then vacuum packed within a can, which must be opened with a can opener, common to most households.

Packing coffee immediately after roasting and grinding provides substantial process savings, as the coffee does not require storage to complete the off-gas process. Also, the off-gas product usually contains high quantities of desirable volatile and semi-volatile aromatic compounds that easily volatilize and prevent the consumer from receiving the full benefit of the coffee drinking process. Furthermore, the loss of these aromatic compounds makes them unavailable for release in a standard container; thereby preventing the consumer from the full reception of the pleasurable burst of aroma of fresh roast and ground coffee. This aroma burst of volatile compounds is much more perceptible in a pressurized package than in a vacuum packed package.

It is therefore an object of the present invention to provide a handled package for roast and ground coffee that provides a lighter weight, fresher packing, easier-opening, peelable seal, and "burpable" closure alternative to a standard heavy can.

SUMMARY OF THE INVENTION

The present invention relates to a fresh packaging system for roast and ground coffee.

The present invention also relates to a method for packing coffee using the fresh packaging system for roast and ground coffee.

DETAILED DESCRIPTION OF THE INVENTION

Figure 1:
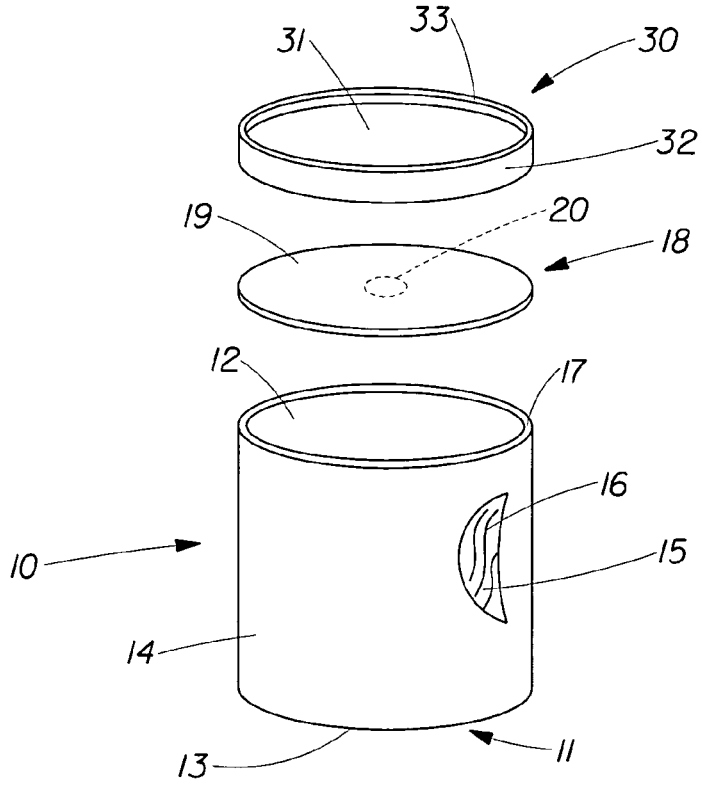
FIG. 1 is an exploded perspective view of a preferred embodiment of the fresh packing system in accordance with the present invention.

The present invention is related to a fresh packaging system for roast and ground coffee. The packaging system comprises a container comprising a closed bottom, and open top and a body having an enclosed perimeter between the bottom and the top where the top, bottom, and body together define an interior volume. A flexible closure is removably attached and sealed to a protuberance disposed around the perimeter of the body proximate to the top. The container bottom and body are constructed from a material having a tensile modulus number ranging from at least about 35,000 (2,381 atm) pounds per square inch to at least about 650,000 pounds per square inch (44,230 atm), which provides a top load capacity of at least about 16 pounds (7.3 Kg).

The invention is more generally related to a method for the packing of coffee using the container of the present invention. The method steps include filling the container system described above with roast and ground coffee, flushing the container with an inert gas, and, sealing the container with a flexible closure.

The invention is also related to an article of manufacture that provides the end user with beneficial coffee aroma characteristics. The article comprises a closed bottom, an open top, and a polyolefin body forming an enclosed perimeter between said bottom and top together defining an interior volume. The body includes a protuberance continuously disposed around the perimeter of the body proximate to the top. A flexible closure is removably attached to the protuberance so that the closure forms a seal with the protuberance. Roast and ground coffee is contained within the interior volume and, the article of manufacture has an overall coffee aroma value of at least about 5.5. (A method for measuring the overall coffee aroma value is described in the Test Methods section, infra.)

The purpose of the present invention, inventive method, and article of manufacture is to provide a useful benefit to the user that includes, but is not limited to, providing a roast and ground coffee with a perceived more fresh and aromatic flavor. Such a container system of the present invention also provides an easy to use and low cost means of delivery of a roast and ground coffee to an end user.

Preferably, but optionally, the container has a handle element disposed thereon. More preferably the handle element is integral with the body of the container. This handle element facilitates gripping of the container system by the end user. This gripping is particularly useful for users with small hands or hands in a weakened condition due to illness, disease, or other medical malady.

Optionally, but preferably, the present invention features a one-way valve located within the closure to release excess pressure built up within the container due to the natural off gas process of roast and ground coffee. It is also believed that changes in external temperature and altitude can also cause the development of pressure internal to the container. The one-way valve is selected to release coffee off gas in excess of a predetermined amount however, remains sealed after such a release, thereby retaining an aromatically pleasing amount of off gassed product within the container.

Another optional, but preferred, feature of the present invention is an overcap placed over the closure. The overcap can comprise a dome, or cavity, that allows positive, outward deformation of the closure due to the pressure build-up within the container. The overcap is preferably air tight and flexible to allow for easy application in manufacture, either with, or without, a closure, and by the end user, after end user removal, of a closure. A flexible overcap can also allow the end user to remove excess air by compressing the dome, thereby releasing excess ambient air from the previously open container (burping). However, the overcap can also exhibit less flexibility or be inflexible. The overcap also provides for a tight seal against the rim of the container after opening by the end user. This tight seal prevents pollution of the rim, resulting in an undesirable expectoration of the overcap after application. The overcap can also optionally allow for stacking several container embodiments when the closure and the dome portion of the overcap are at a point of maximum deflection. The overcap also optionally has a vent to allow for easy removal of vented off gas product trapped between the closure and overcap assemblies, but still allows for "burping."

In a preferred embodiment, the overcap can have a rib disposed proximate to and along the perimeter of the overcap defining an inner dome portion and an outer skirt portion. The rib forms a hinge-like structure so that outward deflection of the inner dome portion caused by deflection of the closure due to coffee off gassing causes the rib to act as a cantilever for the skirt portion. Thus, outward deflection of the dome portion causes the skirt portion to deflect inwardly on an outer portion of the container wall, resulting in an improved seal characteristic and improves retaining forces of the overcap with respect to the container.

The Container

Referring to FIG. 1, fresh packaging system 10, generally comprises a container 11 made from a compound, for example, a polyolefin. Exemplary and non-limiting compounds and polyolefins that can be used for producing the present invention include polycarbonate, linear low-density polyethylene, low-density polyethylene, high-density polyethylene, polyethylene terephthalate, polypropylene, polystyrene, polyvinyl chloride, co-polymers thereof, and combinations thereof. It should be realized by one skilled in the art that container 11 of the present invention can take any number of shapes and be made of any number of suitable materials. Container 11 generally comprises an open top 12, a closed bottom 13, and a body portion 14. Open top 12, closed bottom 13, and body portion 14 define an inner volume in which a product is contained. Also, closed bottom 13 and body portion 14 are formed from a material having a tensile modulus ranging from at least about 35,000 pounds per square inch (2,381 atm) to at least about 650,000 pounds per square inch (44,230 atm), more preferably from at least about 40,000 pounds per square inch (2,721 atm) to at least about 260,000 pounds per square inch (17,692 atm), and most preferably ranging from at least about 95,000 pounds per square inch (6,464 atm) to at least about 150,000 pounds per square inch (10,207 atm). Tensile modulus is defined as the ratio of stress to strain during the period of elastic deformation (i.e., up to the yield point). It is a measure of the force required to deform the material by a given amount and is thus, a measure of the intrinsic stiffness of the material.

It is preferred that bottom portion 13 be disposed concave inwardly, or recessed, towards the inner volume so that undesirable deflections caused by pressure increases within the inner volume are minimized. If the bottom 13 expands outwardly sufficiently, causing the bottom 13 to concave outwardly, then the container 11 will develop what is generally referred to in the art as "rocker bottom." That is, if the bottom 13 deflects outwardly so that the container system 10 will not be stable while resting on a flat surface, fresh packaging system 10 will tend to rock back and forth.

Figure 7:
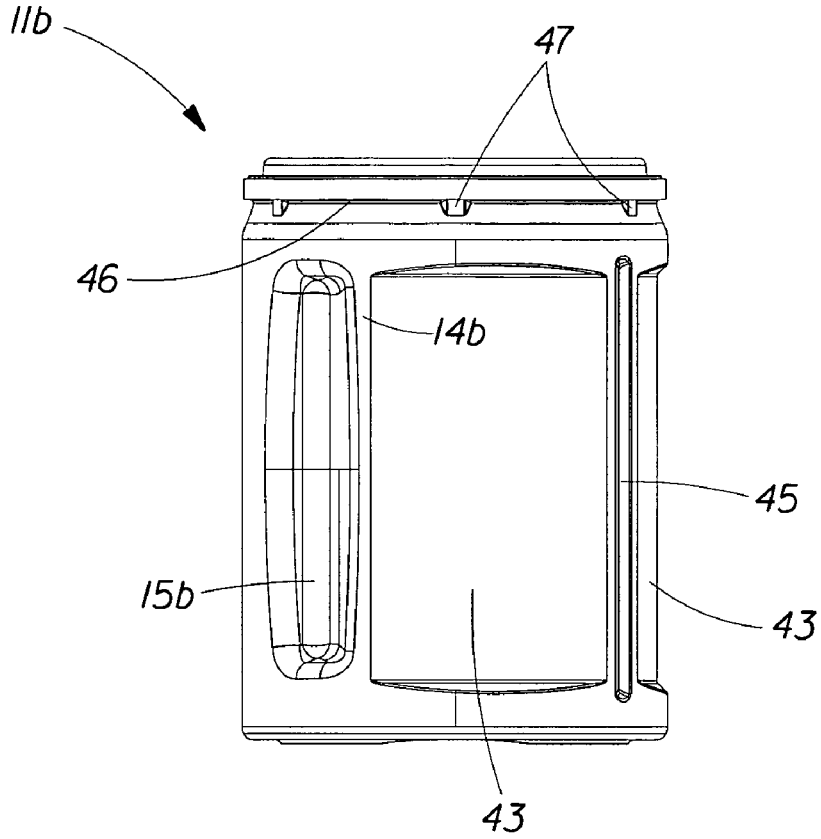
FIG. 7 is an elevational view of an alternative embodiment of the fresh packing system.
Figure 7A:
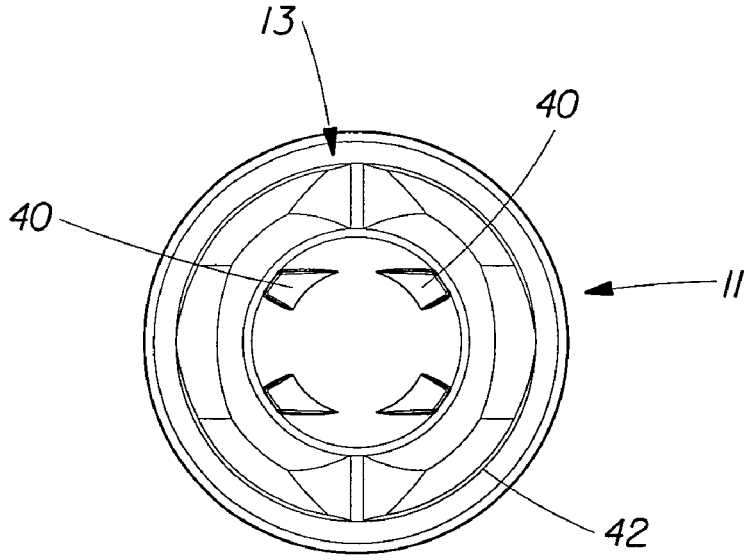
FIG. 7A is a bottom planar view of the embodiment of FIG. 7.

As shown in FIG. 7A, a plurality of protrusions 40 can be disposed on the closed bottom 13 of container 11 about the longitudinal axis of container 11. In a preferred embodiment, protrusions 40 form an oblique angle with the closed bottom 13 of container 11. If the container 11 assumes a cylindrical shape, it is believed that protrusions 40 can be rectilinearly disposed about the diameter of the closed bottom 13 of container 11. However, one of skill in the art would realize that protrusions 40 could be disposed on the closed bottom 13 of container 11 in any geometrical arrangement. Without wishing to be bound by theory, it is believed that protrusions 40 can protrude past the geometry of the closed bottom 13 of container 11 upon an outward deflection of the closed bottom 13 of container 11. In this way container 11 can maintain a stable relationship with other surfaces should "rocker bottom" be realized upon the development of an outward pressure from within container 11. While the preferred embodiment utilizes four protrusions 40 disposed on closed bottom 13, it should be realized by one of skill in the art that virtually any number of protrusions 40 could be disposed on closed bottom 13 to yield a stable structure upon outward deflection of closed bottom 13. Additionally, protrusions 40 could be a square, triangular, elliptical, quadlobe, pentaloid, trapezoidal, arranged in multiply nested configurations, provided in an annular ring about closed bottom 13, and combinations thereof.

Again referring to FIG. 7A, an annular ring 42, or any other raised geometry, including interrupted geometrical configurations, can be disposed on closed bottom 13 of container 11. Annular ring 42 could be dimensioned to facilitate nesting, or stacking, of multiple embodiments of containers 11. In other words, annular ring 42 could be designed to provide serial stacking of a container 11 onto the overcap 30 of the preceding, or lower, container 11. Without wishing to be bound by theory, it is believed that the facilitation of nesting by the use of annular ring 42 disposed on closed bottom 13 of container 11 provides enhanced structural stability.

It is also believed that the closed bottom 13 of container 11 could be designed, in what is known to those of skill in the art, as a quad lobe, or pentaloid. Again, without desiring to be bound by theory, it is believed that such a quad lobe, or pentaloid, design could provide enhanced ability to resist the deformation of closed bottom 13 of container 11 due to internal pressures developed within container 11.

Referring again to FIG. 1, container 11 can be cylindrically shaped with substantially smooth sides. Handle portions 15 are respectively formed in container body portion 14 at arcuate positions. A plurality of anti-slip strips 16 can be formed at a predetermined interval within handle portions 15. Handle portions 15 are formed as would be known to one skilled in the art to provide a gripping surface at a most efficacious position to enable users with small hands or debilitating injuries or maladies to grip container portion 11 with a minimum of effort. Further, container 11 can be readily grasped by hand due to the configuration described above. Additionally, container 11 can have a protuberance 17 in the form of a rim like structure disposed at the open end of container 11. Protuberance 17 can provide a surface with which to removeably attach closure 18 and provide a locking surface for skirt portion 32 of overcap 30.

Figure 2:
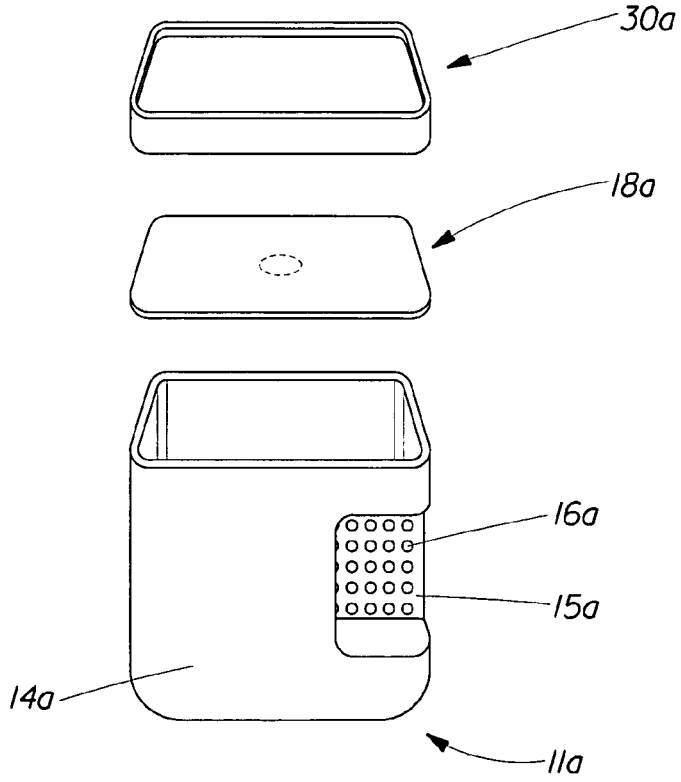
FIG. 2 is an exploded perspective view of an alternative embodiment of the fresh packing system.

In an alternative embodiment as shown in FIG. 2, container 11*a* is parallelpiped shaped with substantially smooth sides. Handle portions 15*a* are respectively formed in container body portion 14*a* at arcuate positions. A plurality of gripping projections 16*a* are formed at a predetermined interval within handle portions 15*a*. Corresponding closure 18*a* and overcap 30*a* are fitted on container 11*a* as would be known to one skilled in the art.

In an alternative embodiment, as shown in FIG. 7, handle portions 15*b* can preferably be symmetrical. Without desiring to be bound by theory, it is believed that symmetrical handle portions 15*b* could prevent inversion of the handle portions 15*b* upon an increase in pressure from within container 11*b*. It is believed that symmetrically incorporated handle portions 15*b* provides for the uniform distribution of the internal pressure, developed within container 11, throughout handle portion 15*b*.

As is also shown in the alternative embodiment of FIG. 7, all portions of handle portions 15*b* are presented as either parallel to the longitudinal axis of container 11*b* or perpendicular to the longitudinal axis of container 11*b*. Without desiring to be bound by theory, it is believed that handle portions 15*b*, arranged to provide all component portions of handle portions 15*b* to be either parallel or perpendicular to the longitudinal axis of container 11*b*, could be less susceptible to bending forces due to internal pressures developed within container 11*b*. This could aid in the prevention of catastrophic failure of the container due to the pressures generated internally to container 11*b*.

Further, providing container 11*b* with handle portions 15*b* in a recessed configuration with respect to the body portion 14*b* of container 11*b* could require less force from the end user to maintain a firm grip on handle portions 15*b* of container 11*b*. Additionally, recessed handle portions 15*b* could aid in the prevention of an end user supplying extraneous force to the external portions of container 11*b* thereby causing catastrophic failure or deformation of container 11*b*.

Referring again to FIG. 1, container 11 exhibits superior top load strength per mass unit of plastic. With the present invention, filled and capped containers can be safely stacked one upon another without concern that the bottom containers will collapse or be deformed. Often, containers are palletized, by which several containers are stacked in arrays that take on a cubic configuration. In the order of 60 cases, each weighing about 30 pounds (13.6 Kg) can be loaded onto a pallet. In certain instances, these pallets can be stacked one upon another. It will be appreciated that the bottommost containers will be subjected to extraordinary columnar forces. Traditionally, polymeric containers are not capable of withstanding such high column forces. Thus, to avoid collapsing or buckling of these stacking situations, the top load resistance of each container should be at least about 16 pounds (7.3 Kg) when the containers are in an ambient temperature and pressure environment. More preferably, each container should exhibit a top load resistance of at least about 48 pounds (21.8 Kg) in accordance with the present invention.

In the present invention, top load resistance is the amount of force an empty container can support prior to the occurance of a deflection parallel to the longitudinal axis of the container of greater than 0.015 inches. By way of a non-limiting example, a cylindrical container comprising a laminate structure (as detailed infra), having an average overall mass of 39 grams, an average internal volume of approximately 950 cubic centimeters, an average wall thickness of approximately 0.030 inches, and an average diameter of approximately 100 millimeters is considered not to have a top load resistance greater than 16 pounds (7.3 Kg) when the container deflects more than 0.015 inches in a direction parallel to the longitudinal axis when a 16 pound load is placed thereupon. As is known to one of skill in the art, top load resistance can be measured using a suitable device such as an Instron, model 550R1122, manufactured by Instron, Inc., Canton, Mass. The Instron is operated in a compressive configuration with a 1000 pound load cell and a crosshead speed of 1.0 inch/minute. The load is applied to the container through a platen that is larger than the diameter of the subject container.

As shown in FIG. 7, the body portion 14*b* of container 11*b* can have at least one region of deflection 43 placed therein to isolate deflection of the container 11*b* due to either pressures internal to container 11*b* or pressures due to forces exerted upon container 11*b*. As shown, at least one region of deflection 43 could generally define rectilinear regions of container 11*b* defined by a cylindrical wall. However, one of skill in the art would realize that at least one region of deflection 43 incorporated into body portion 14*b* could assume any geometry, such as any polygon, round, or non-uniform shape. Without wishing to be bound by theory, it is believed that a purely cylindrical container 11*b*, having a uniform wall thickness throughout, will resist compression due to pressure exerted from within container 11*b* or external to container 11*b*. However, without desiring to be bound by theory, it is believed that when applied forces exceed the strength of the container wall of purely cylindrical container 11*b*, deflection could be exhibited in an undesireable denting or buckling. Any non-uniformities present in a purely cylindrical container 11*b*, such as variations in wall thickness, or in the form of features present, such as handle portions 15*b*, can cause catastrophic failure upon a differential pressure existing between regions external to container 11*b* and regions internal to container 11*b*.

However, the incorporation of at least one region of deflection 43 is believed to allow flexion within the body portion 14*b* of container 11*b*. Thus, it is believed that body portion 14*b* can deform uniformly without catastrophic failure and can resist undesirable physical and/or visual effects, such as denting. In other words, the volume change incurred by container 11*b* due to internal, or external, pressures works to change the ultimate volume of the container 11*b* to reduce the differential pressure and thus, forces acting on the container wall. It is also believed, without desiring to be bound by theory, that the incorporation of a solid or liquid, or any other substantially incompressible material, can provide substantial resistance to the inward deflection of at least one region of deflection 43. For example, the inclusion of a powder, such as roast and ground coffee, could provide resistance to the inward deflection of at least one region of deflection 43, thus enabling at least one region of deflection 43 to remain substantially parallel to the longitudinal axis of container 11*b* and thereby providing an effective increase in the top load capability of container 11*b*. The peelable laminate seal also deflects with external pressure changes further reducing the pressure load on the container.

In a non-limiting, but preferred embodiment, container 11*b* has at least one region of deflection 43 that can be presented in the form of rectangular panels. The panels have a radius that is greater than the radius of container 11*b*. The panels are designed to have less resistance to deflection than that of the region of container 11*b* proximate to the rectangular panels. Thus, any movement exhibited by the panels is isolated to the panels and not to any other portion of container 11*b*.

As shown in FIG. 1, without desiring to be bound by theory, it is believed that the chime should be sufficient to allow container 11 to compress under vacuum by adapting to base volume changes and will improve the top loading capability of container 11. However, it is further believed that the chime should be as small as is practicable as would be known to one of skill in the art.

As shown in FIG. 7, the body portion 14*b* of container 11*b* can also have at least one rib 45 incorporated therein. It is believed that at least one rib 45 can assist in the effective management of isolating the movement of at least one panel 43 by positioning at least one rib 45 parallel to the longitudinal axis of container 11*b* and proximate to at least one panel 43 in order to facilitate the rotational movement of at least one panel 43 upon an inward, or outward, deflection of at least one panel 43. Further, it is believed that at least one rib 45 can also provide added structural stability to container 11*b* in at least the addition of top load strength. In other words, at least one rib 45 could increase the ability of container 11*b* to withstand added pressure caused by the placement of additional containers or other objects on top of container 11*b*. One of skill in the art would be able to determine the positioning, height, width, depth, and geometry of at least one rib 45 necessary in order to properly effectuate such added structural stability for container 11*b*. Further, it would be known to one of skill in the art that at least one rib 45 could be placed on container 11*b* to be parallel to the longitudinal axis of container 11*b*, annular about the horizontal axis of container 11*b*, or be of an interrupted design, either linear or annular to provide the appearance of multiple panels throughout the surface of container 11*b*.

Additionally, container 11*b* can generally have a finish 46 incorporated thereon. In a preferred embodiment, the finish 46 is of an annular design that is believed can provide additional hoop strength to container 11*b* and surprisingly, can provide a finger well 44 to assist the user in removal of overcap 30. Further, it is possible for one of skill in the art to add ribs 47 to finish 46 in order to provide further strength to container 11*b* in the form of the added ability to withstand further top loading. In a preferred embodiment, ribs 47 are disposed parallel to the horizontal axis of container 11*b* and perpendicular to finish 46.

Figure 11:
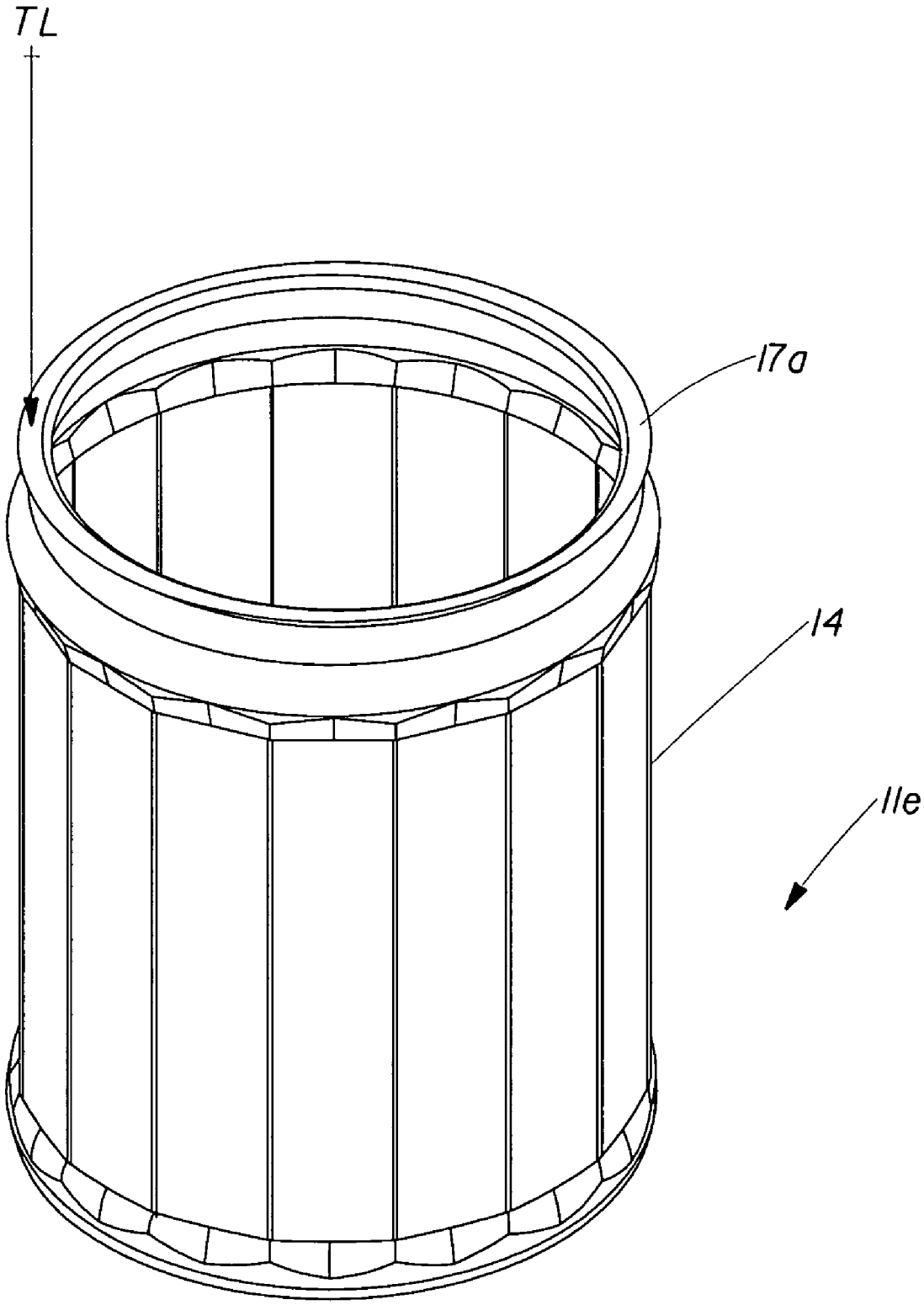
FIG. 11 is a perspective view of an alternative embodiment of the fresh packaging system.
Figure 12:
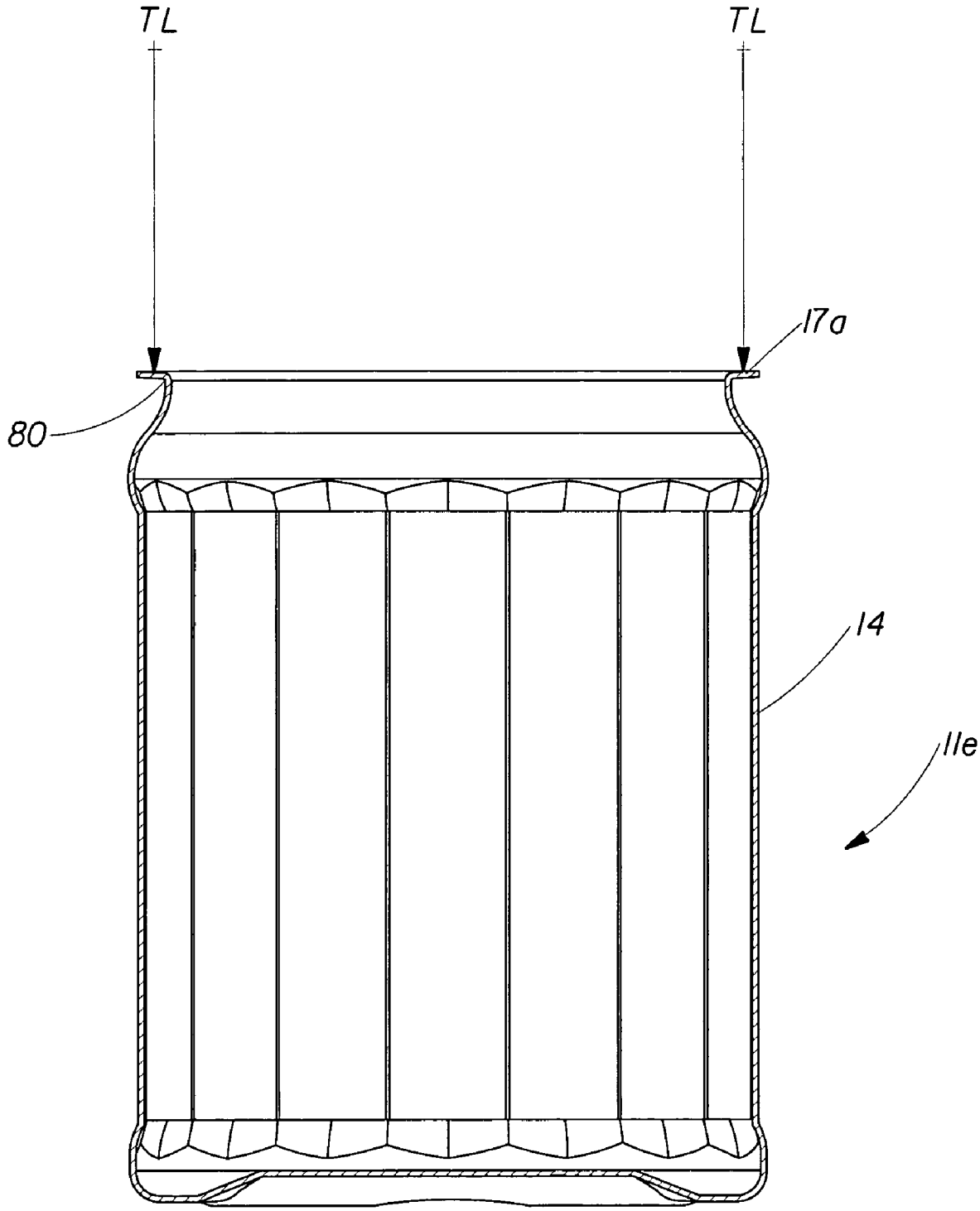
FIG. 12 is a cross-sectional view of FIG. 11 along line 12—12; and, FIG. 13 is a cross-sectional view of another exemplary overcap assembly for a fresh packing system.

Referring to FIGS. 11 and 12, it was found that a container 11*e* provided with a protuberance 17*a* that is at least substantially outwardly facing from body portion 14 and substantially perpendicular to the longitudinal axis of container 11*e* can have less induced structural stress caused by a vacuum internal to container 11*e* in the junction 80 proximate to the interface of protuberance 17*a* and body portion 14. Without desiring to be bound by theory, it is believed that such forces exerted on an outwardly facing protuberance 17*a* would cause an increase in the radius of curvature of protuberance 17 with respect to body portion 14, thereby reducing the overall vacuum induced stresses on the container 11*e*. Reducing vacuum-induced stresses can facilitate producing container 11*e* with a smaller overall wall thickness.

In addition, it can be desirable for container 11*e* to be provided with at least a substantially outwardly facing protuberance 17*a* so that static vertical loads (TL) are transferred through the body portion 14 rather than through protuberance 17*a*. Without desiring to be bound by theory, it is believed that transferring the forces exerted by a load (TL) positioned on top of container 11*e* through body portion 14 rather than upon protuberance 17*a* can reduce overall stresses at junction 80 of protuberance 17*a* with body portion 14. This reduction in stresses at junction 80 can facilitate producing container 11*e* with a smaller overall wall thickness.

Further, container 11*e* can be combined with an overcap (not shown) that can substantially direct the forces exerted by a load to body portion 14 rather than to protuberance 17*a*. It is believed that any stress at junction 80 caused by a load positioned on top of container 11*e* having such an overcap (not shown) disposed theron can be reduced because the deflection of the cantilevered protuberance 17*a* is restrained. This can result in lower concentrations of stress at junction 80.

Returning again to FIG. 1, the container 11 is preferably produced by blow molding a polyolefinic compound. Polyethylene and polypropylene, for example, are relatively low cost resins suitable for food contact and provide an excellent water vapor barrier. However, it is known in the art that these materials are not well suited for packaging oxygen-sensitive foods requiring a long shelf life. As a non-limiting example, ethylene vinyl alcohol (EVOH) can provide such an excellent barrier. Thus, a thin layer of EVOH sandwiched between two or more polyolefinic layers can solve this problem. Therefore, the blow-molding process can be used with multi-layered structures by incorporating additional extruders for each resin used. Additionally, the container of the present invention can be manufactured using other exemplary methods including injection molding and stretch blow molding.

In a preferred embodiment in accordance with the present invention, container 11 of FIG. 1, container 11*a* of FIG. 2, and container 11*b* of FIG. 7, can be blow molded from a multi-layered structure to protect an oxygen barrier layer from the effects of moisture. In a preferred embodiment, this multi-layered structure can be used to produce an economical structure by utilizing relatively inexpensive materials as the bulk of the structure.

Another exemplary and non-limiting example of a multi-layered structure used to manufacture the container of the present invention would include an inner layer comprising virgin polyolefinic material. The next outward layer would comprise recycled container material, known to those skilled in the art as a 'regrind' layer. The next layers would comprise a thin layer of adhesive, the barrier layer, and another adhesive layer to bind the barrier layer to the container. The final outer layer can comprise another layer of virgin polyolefinic material.

A further exemplary and non-limiting example of a multi-layered structure used to manufacture the container of the present invention would include an inner layer comprising virgin polyolefinic material. The next layers would comprise a thin layer of adhesive, the barrier layer, and another adhesive layer to bind the barrier layer to the container. The next outward layer would comprise recycled container material, known to those skilled in the art as a 'regrind' layer. The final outer layer can comprise another layer of virgin polyolefinic material. In any regard, it should be known to those skilled in the art that other potential compounds or combinations of compounds, such as polyolefins, adhesives and barriers could be used. Further, an oxygen scavenger can be incorporated into, or on, any layer of a multi-layered structure to remove any complexed or free oxygen existing within a formed container. Such oxygen scavengers can include oxygen scavenging polymers, complexed or non-complexed metal ions, inorganic powders and/or salts, and combinations thereof, and/or any compound capable of entering into polycondensation, transesterification, transamidization, and similar transfer reactions where free oxygen is consumed in the process.

Other such materials and processes for container formation are detailed in *The Wiley Encyclopedia of Packaging Technology*, Wiley & Sons (1986), herein incorporated by reference. Preferably, the inner layer of containers 11, 11*a*, and 11*b* are constructed from high-density polyethylene (HDPE).

A preferred polyolefinic, blow molded container in accordance with the present invention can have an ideal minimum package weight for the round containers of FIGS. 1 and 7, or the paralellpiped container of FIG. 2, and yet still provide the top load characteristics necessary to achieve the goals of the present invention. Exemplary materials (low-density polyethylene (LDPE), high density polyethylene (HDPE) and polyethylene terephthalate (PET)) and starting masses of these compounds that provide sufficient structural rigidity in accordance with the present invention are detailed in Table 1 below.

TABLE 1

Package Shape and Weight For a Given Material and a Defined Top Load (Empty) for a Nominal 3.0 L Container

| Package Configuration | Package Material & Tensile Modulus (psi/atm) | Package Weight 35 lb. Top Load (grams) | Package Weight 120 lb. Top Load (grams) |
|---|---|---|---|
| Parallelpiped | LDPE (40,000/2,721) | 79 grams | 146 grams |
| Parallelpiped | HDPE (98,000/6,669) | 66 grams | 123 grams |
| Paralellpiped | PET (600,000/40,828) | 40 grams | 74 grams |
| Round | LDPE (40,000/2,721) | 51 grams | 95 grams |

TABLE 1-continued

Package Shape and Weight For a Given Material and a Defined Top Load (Empty) for a Nominal 3.0 L Container

| Package Configuration | Package Material & Tensile Modulus (psi/atm) | Package Weight 35 lb. Top Load (grams) | Package Weight 120 lb. Top Load (grams) |
|---|---|---|---|
| Round | HDPE (98,000/6,669) | 43 grams | 80 grams |
| Round | PET (600,000/40,828) | 26 grams | 48 grams |

It was surprisingly found that a container in accordance with the present invention that is filled with product and sealed to contain the final product has enhanced properties for the same starting compound weight. This provides a benefit in that it is now possible to use less starting material to provide the top load values in accordance with the present invention. Exemplary materials and starting masses of compounds (LDPE, HDPE, and PET) providing the necessary structural rigidity of a filled and sealed container in accordance with the present invention are detailed in Table 2.

TABLE 2

Package Shape and Weight For a Given Material and a Defined Top Load (Filled) for a Nominal 3.0 L Container

| Package Configuration | Package Material & Tensile Modulus (psi/atm) | Package Weight 35 lb. Top Load (grams) | Package Weight 120 lb. Top Load (grams) |
|---|---|---|---|
| Paralellpiped | LDPE (40,000/2,721) | 72 grams | 134 grams |
| Paralellpiped | HDPE (98,000/6,669) | 61 grams | 112 grams |
| Paralellpiped | PET (600,000/40,828) | 37 grams | 68 grams |
| Round | LDPE (40,000/2,721) | 47 grams | 87 grams |
| Round | HDPE (98,000/6,669) | 39 grams | 73 grams |
| Round | PET (600,000/40,828) | 24 grams | 44 grams |

Again referring to FIG. 1, protuberance 17, in the form of a rim like structure, disposed at the open end of container 11 may have textured surfaces disposed thereon. Textured surfaces disposed on protuberance 17 can comprise raised surfaces in the form of protuberances, annular features, and/or cross-hatching to facilitate better sealing of removable closure 19. Exemplary, but non-limiting, annular features may include a single bead or a series of beads as concentric rings protruding from the seal surface of protuberance 17. While not wishing to be bound by theory, it is believed that a textured surface on protuberance 17 can allow for the application of a more uniform and/or concentrated pressure during a sealing process. Textured surfaces can provide increased sealing capability between protuberance 17 and removeable closure 19 due to any irregularities introduced during molding, trimming, shipping processes and the like during manufacture of container 11.

The Removable Closure

Again referring to FIG. 1, fresh packaging system 10 comprises a closure 18 that is a laminated, peelable seal 19 that is removeably attached and sealed to container 11. Peelable seal 19 has a hole beneath which is applied a degassing valve, indicated as a whole by reference number 20. One-way valve 20 can be heat welded or glued to peelable seal 19.

Figure 3:
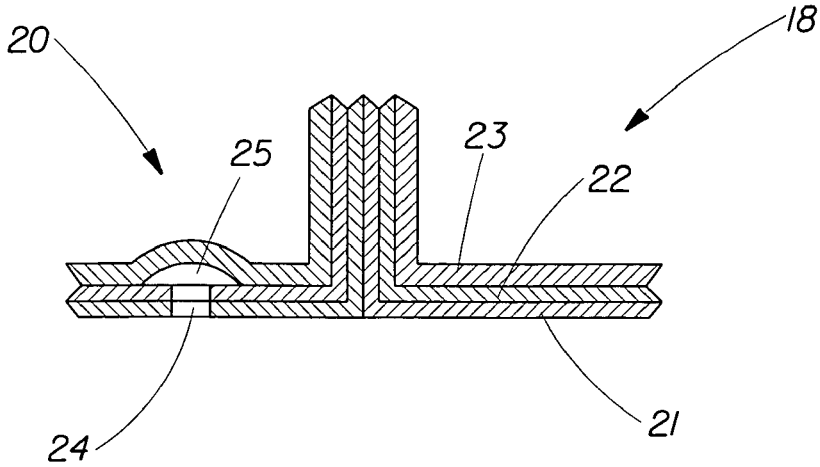
FIG. 3 is a cross-sectional view of an exemplary closure and one-way valve assembly for the fresh packing system.

In a preferred embodiment according to FIG. 3, the interior of peelable seal 19 to the outer side of peelable seal 19 is a laminate and comprises, in sequence, an inner film 21, such as polyethylene, a barrier layer 22, such as a metallized sheet, preferably metallized PET, metallized PE, or aluminum, and an outer film of plastic 23, such as PET. Inner film 21 is preferably formed from the same material as the outer layer of container 11. Thus, inner film 21 is preferably a polyolefin, and more preferably polyethylene (PE). Plastic outer film 23 is preferably produced from a material such as polyester. However, one skilled in the art would realize that other materials, such as a foil closure, and other stretchable and non-stretchable layer structures can be used and still remain within the scope of the present invention. Additionally, an oxygen scavenger, as described supra, can be incorporated into, or on, any layer of peelable seal 19 to remove free, or complexed, oxygen.

Both inner film 21 and barrier layer 22 are perforated, preferably by means of cuts, pricks, or stampings, to form flow opening 24, as shown in FIG. 3. In the area above the outlet opening, outer film 23 is not laminated to barrier layer 22, thereby forming longitudinal channel 25. Channel 25 extends the entire width of the laminate so that during manufacture, channel 25 extends to the edge of closure 18.

As a result, a very simple and inexpensive one-way valve 20 is formed by means of the non-laminated area of outer film 23 and outlet opening 24. The gases produced by the contents within container 11 may flow through valve 20 to the surrounding environment. Since an overpressure exists in container 11, and since outer film 23 usually adheres or at least tightly abuts barrier layer 22 because of the inner pressure, unwanted gases, such as oxygen, are prevented from flowing into container 11 and oxidizing the contents. Thus, outer film 23 serves as a membrane that must be lifted by the inner gas pressure in the packing in order to release gas. It is preferred that one-way valve 20 respond to pressures developed within container 11. This pressure can exceed 10 millibars, and preferably exceed 15 millibars, and more preferably would exceed 20 millibars, and most preferably, exceed 30 millibars.

Additionally, a small amount of liquid can be filled into channel 25. The liquid can be water, siloxane-based oils, or oil treated with an additive so that the oil is prevented from becoming rancid prior to use of the product. The pressure at which the release of internal off gas from container 11 occurs can be adjusted by varying the viscosity of the liquid within channel 25.

In an alternative, but non-limiting, embodiment, a one-way degassing valve can comprise a valve body, a mechanical valve element, and a selective filter as described in U.S. Pat. No. 5,515,994, herein incorporated by reference.

Returning to FIG. 1, Closure 18 is preferably sealed to container 11 along a rim (protuberance) 17 of container 11. Preferable, but non-limiting, methods of sealing include a heat sealing method incorporating a hot metal plate applying pressure and heat through the closure material and the container rim, causing a fused bond. The peel strength achieved is generally a result of the applied pressure, temperature, and dwell time of the sealing process. However, it should be known to one skilled in the art, that other types of seals and seal methods could be used to achieve a bond with sufficient and effective seal strength, including, but not limited to, a plurality of annular sealing beads disposed on rim 17.

Alternatively, if protuberance 17 is provided in at least a substantially outwardly facing orientation from body portion 14 and substantially perpendicular to the longitudinal axis of container 10, protuberance 17 can be supported during the sealing process. Providing support in this manner can allow for a seal to be applied in less overall time through the use of higher temperature and pressure than would be possible if the flange were unsupported. It is also believed that supporting protuberance 17 during the sealing process can result in a higher quality seal, provide less variation in the seal, and provide a more consistent peel force. It is also believed that supporting protuberance 17 during a sealing process can reduce the time necessary to provide such seals resulting in lower production costs.

Figure 8:
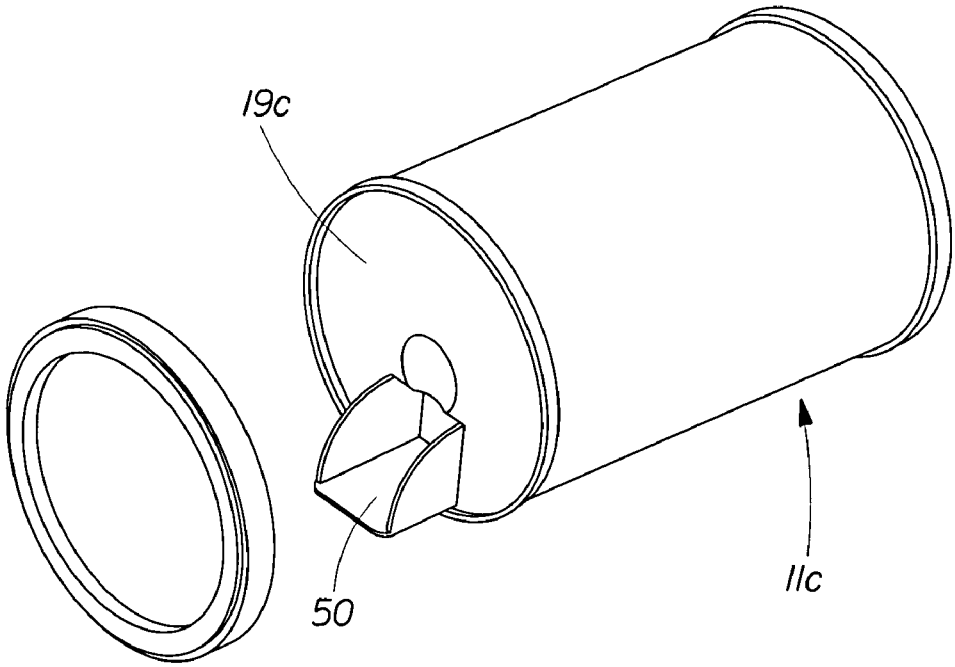
FIG. 8 is a perspective view of an alternative embodiment of the fresh packing system.

As shown in FIG. 8, in an alternative embodiment, peelable seal 19*c* of container 11*c* can include a pivotable pouring device 50. Pivotable pouring device 50 can be placed at any location on peelable seal 19*a* or at any position on container 11*c*. In a preferred embodiment, it is also believed that pivotable pouring device 50 could be disposed on a non-peelable seal located under peelable seal 19*c* in the interior volume of container 11*c*. This could enable a user to remove peelable seal 19*c*, exposing the non-peelable seal having the pivotable pouring device 50 disposed thereon. The user could then pivot the pivotable pouring device 50 to dispense a product contained within container 11*c*. After dispensing the product from container 11*c* via pivotable pouring device 50, the user could pivot the pivotable pouring device 50 to effectively close non-peelable seal, thereby effectively sealing container 11*c*. As would be known to one of skill in the art, exemplary, but non-limiting, examples of pivotable pouring device 50 include pouring spouts, It is believed that pivotable pouring device 50 could have dimensions that facilitate the flow of product from container 11*c*, as would be known to one of skill in the art. A depression, slot, or other orifice can be disposed on either peelable seal 19*c* or the non-peelable seal to facilitate insertion of a user's appendage or other device to aid in the application of force necessary to pivot pivotable pouring device 50.

Figure 8A:
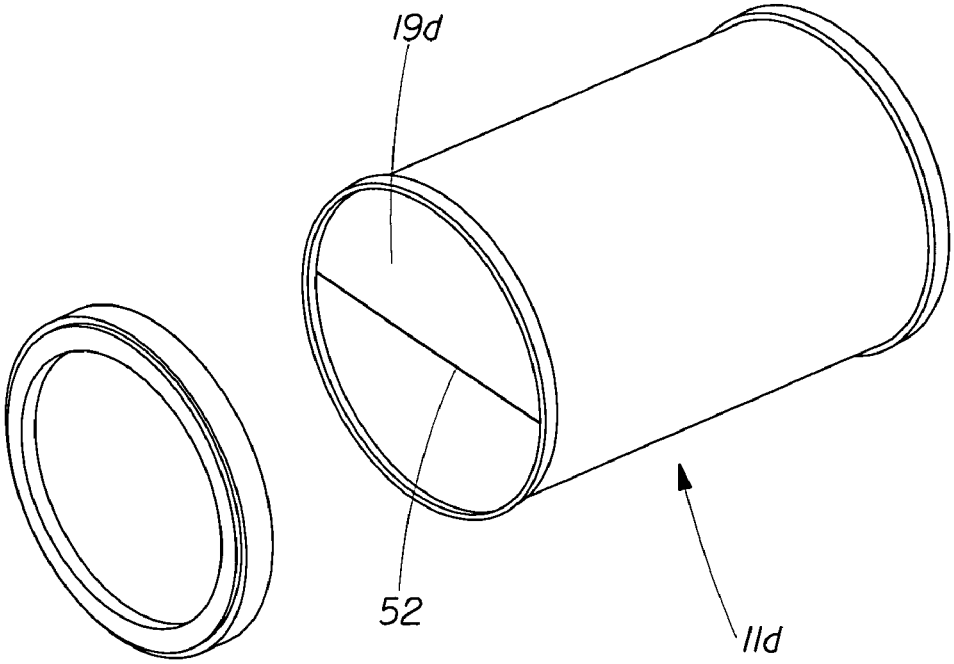
FIG. 8*a* is a perspective view of an alternative embodiment of the fresh packing system.

In the alternative embodiment of FIG. 8*a*, a striker bar 52, formed from either a portion of peelable seal 19*d* or a non-peelable seal, can be used to strike off excess product from a volumetric measuring device. Without wishing to be bound by theory, it is believed that striker bar 52 could facilitate more consistent measurements of product by increase the packing density and volume present within the volumetric measurement device. Further, it is believed that the presence of the remainder of peelable seal 19*d* or a non-peelable seal can assist in the retention of the various aromatic and non-aromatic gasses that naturally evolutes from a product held within container 11*d*.

The Overcap

Referring to FIG. 1, fresh packaging system 10 optionally comprises an overcap 30 comprised of dome portion 31, skirt portion 32, rib 33, and optionally vent 34. As a non-limiting example, overcap 30 is generally manufactured from a plastic with a low flexural modulus, for example, linear low-density polyethylene (LLDPE), low-density polyethylene (LDPE), high-density polyethylene (HDPE), polyethylene (PE), polypropylene (PP), linear low-density polyethylene (LLDPE), polycarbonate, polyethylene terephthalate (PET), polystyrene, polyvinyl chloride (PVC), copolymers thereof, and combinations thereof. This allows for an overcap 30 that has a high degree of flexibility, yet, can still provide sufficient rigidity to allow stacking of successive containers. By using a flexibile overcap 30, mechanical application during packaging as well as re-application of overcap 30 to container 11 after opening by the consumer is facilitated. A surprising feature of a flexible overcap 30 is the ability of the end user to "burp" excess atmospheric gas from container 11 thereby reducing the amount of oxygen present. Further, an oxygen scavenger, as described supra, can be incorporated into, or on, any layer of peelable seal 19 to remove free, or complexed, oxygen. Additionally, the desired balance of flexibility and rigidity exhibited by overcap 30 is to varying the thickness profile of the overcap 30. For example, the dome portion 31 can be manufactured to be thinner than skirt portion 32 and rib 33.

Dome portion 31 is generally designed with a curvature, and hence height, to accommodate for an outward displacement of closure 18 from container 11 as a packaged product, such as roast and ground coffee, off gases. The amount of curvature needed in dome portion 31 can be mathematically determined as a prediction of displacement of closure 18. As a non-limiting example, a nominal height of dome portion 31 can be 0.242 inches (0.61 cm) with an internal pressure on closure 18 of 15 millibars for a nominal 6-inch (15.25 cm) diameter overcap. Further, the dome portion 31 is also generally displaceable beyond its original height as internal pressure rises in container 11, causing closure 18 to rise prior to the release of any off gas by one-way valve 20.

Figure 9:
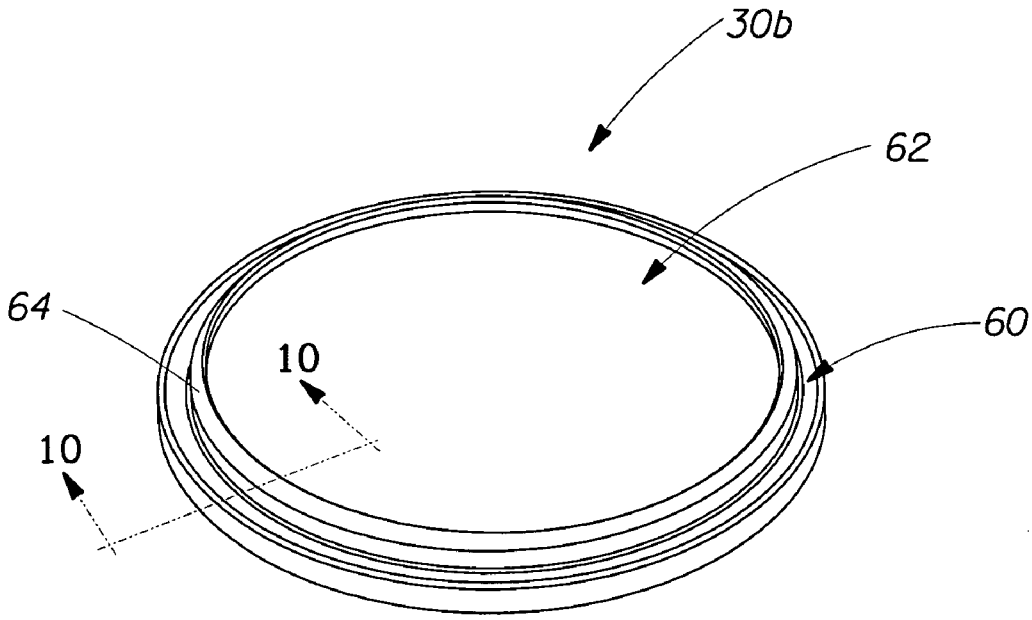
FIG. 9 is an isometric view of an alternative exemplary overcap for use with a fresh packing system.
Figure 9A:
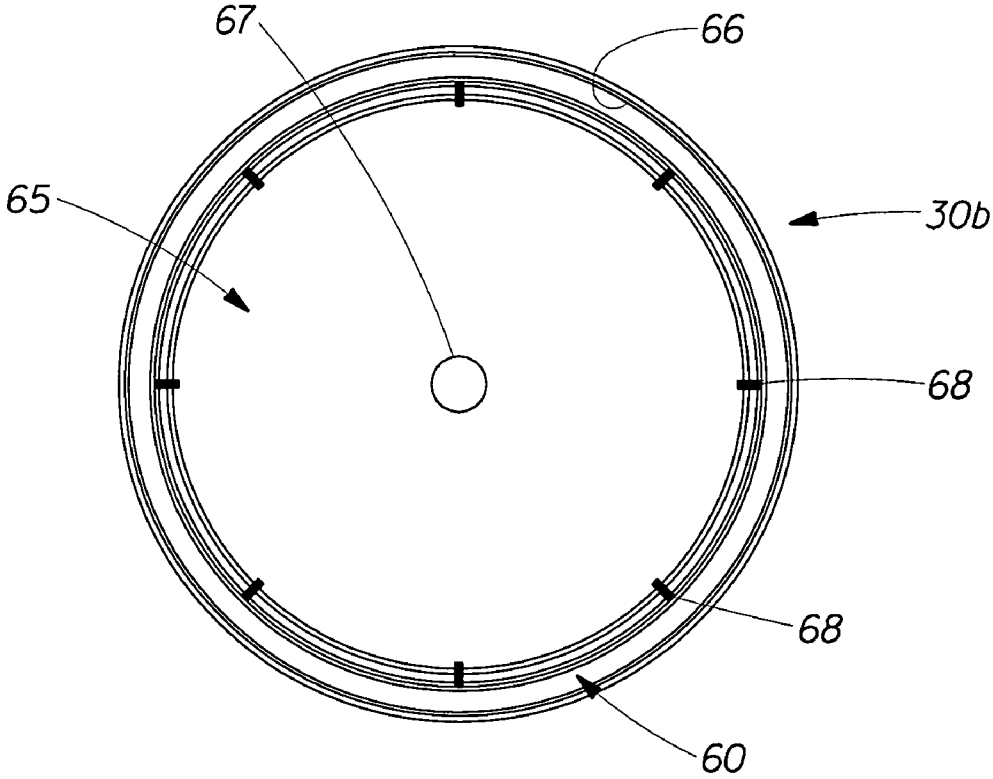
FIG. 9*a* is a bottom planar view of the alternative exemplary overcap of FIG. 9.
Figure 13:
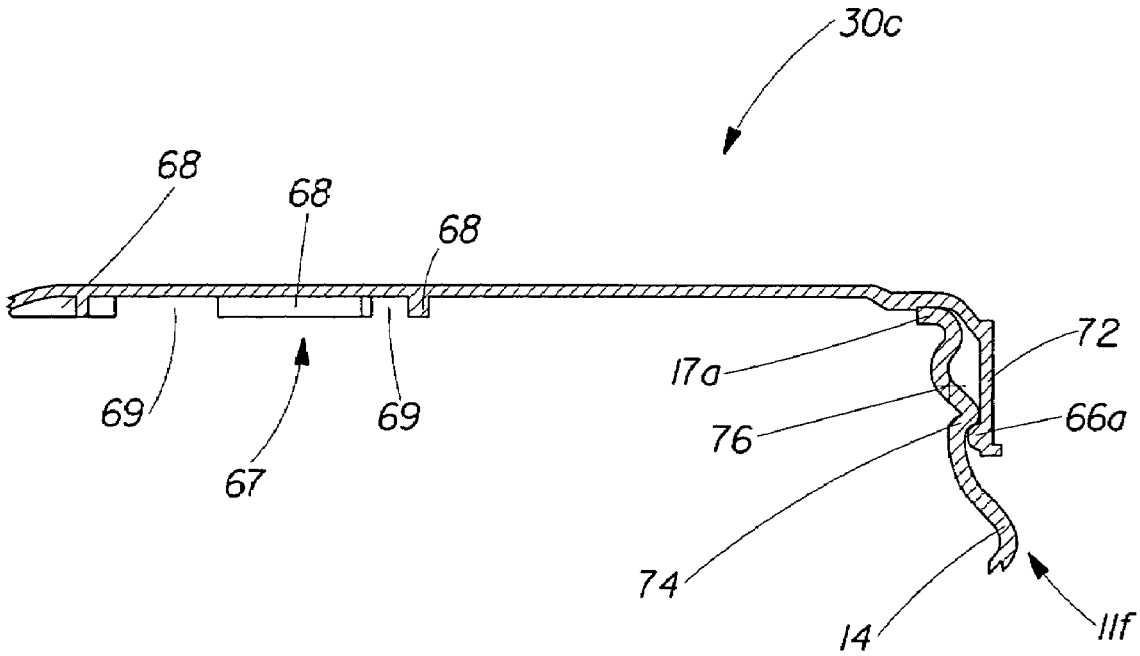

As shown in the exemplary embodiment of FIG. 9A, stand-off 67 can be provided on the underside of overcap 30*b* to facilitate the release of an off gas that may be present within a container. In this way, stand-off 67 can prevent blockage of a valve disposed on and/or within a flexible film closure by lower portion 65 of overcap 30*b* by reducing the amount of contact of the valve with lower portion 65. Stand-off 67 can be constructed in various designs including but not limited to a singular, or plurality of, arcuate forms, circles, rectangles, lines, and combinations thereof. Preferably, a circular stand-off 67 is positioned in a region central to lower portion 65 of overcap 30*b*. It is believed that stand-off 67 can also facilitate the venting of gasses internal to a container. Another such exemplary stand-off 67 is shown in FIG. 13 as a plurality of annular sections 68, wherein each annular section 68 is provided with an opening 69 wherein the plurality of openings 69 provides a path for venting of gasses internal to container 11*f*.

Figure 4:
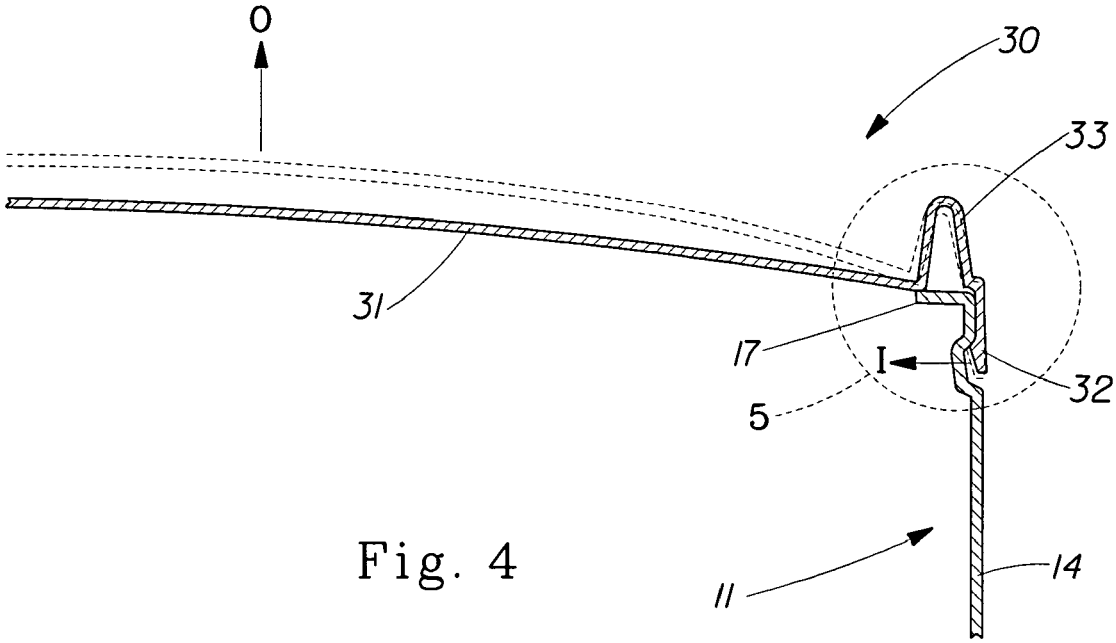
FIG. 4 is a cross-sectional view of an exemplary overcap assembly for a fresh packing system.

Referring to FIG. 4, overcap 30 comprises a rib 33. Rib 33 protrudes outwardly from the generally planar dome portion 31 and serves as a physical connection between dome portion 31 and skirt 32. Generally, skirt 32 has a hook shape for lockingly engaging protuberance 17 of container 11. Rib 33 isolates skirt 32 from dome portion 31, acting as a cantilever hinge so that outward deflections (O) of dome portion 31 are translated into inward deflections (I) of skirt 33. This cantilevered motion provides for an easier application of overcap 30 to container 11 and serves to effectively tighten the seal under internal pressures.

Additionally, rib 33 can allow for successive overcaps to be stacked for shipping. Skirt 32 preferably has a flat portion near the terminal end to allow for nesting of successive overcaps. Furthermore, rib 33 can extend sufficiently away from dome portion 31 so that successive systems may be stacked with no disruption of the stack due to a maximum deflection of closure 18 and the dome portion 31 of overcap 30. Without desiring to be bound by theory, it is believed that the downward load force rests entirely on rib 33 rather than across dome portion 31. Resting all downward forces on rib 33 also protects closure 18 from a force opposing the outward expansion of closure 18 from container 11 due to the off gas generated by a contained product.

Figure 5:
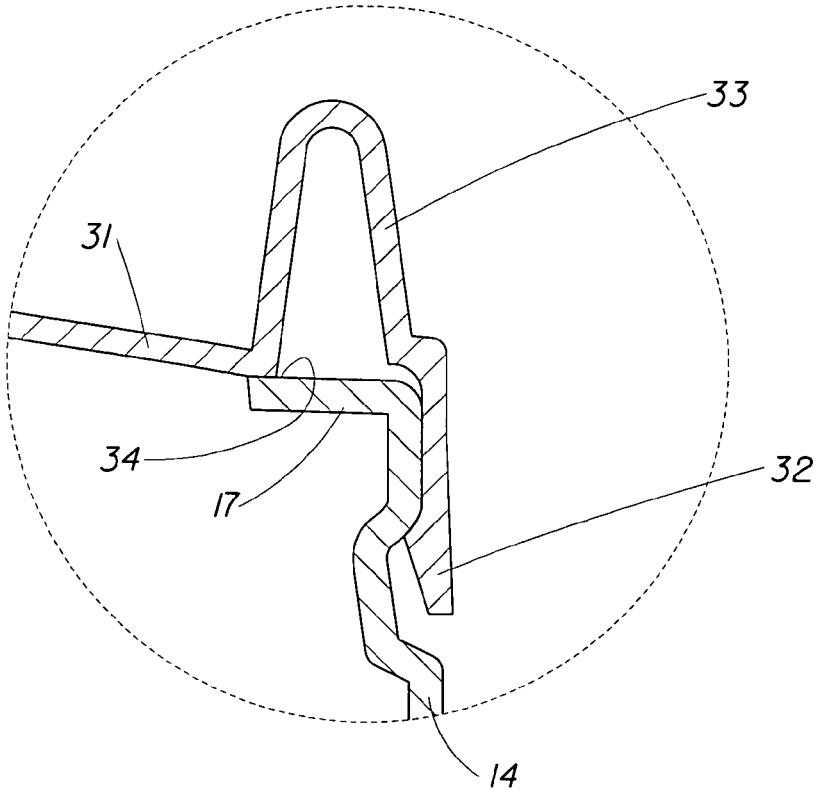
FIG. 5 is an expanded, cross-sectional view of the region labeled 5 in FIG. 4 of the overcap in an applied position.
Figure 6:
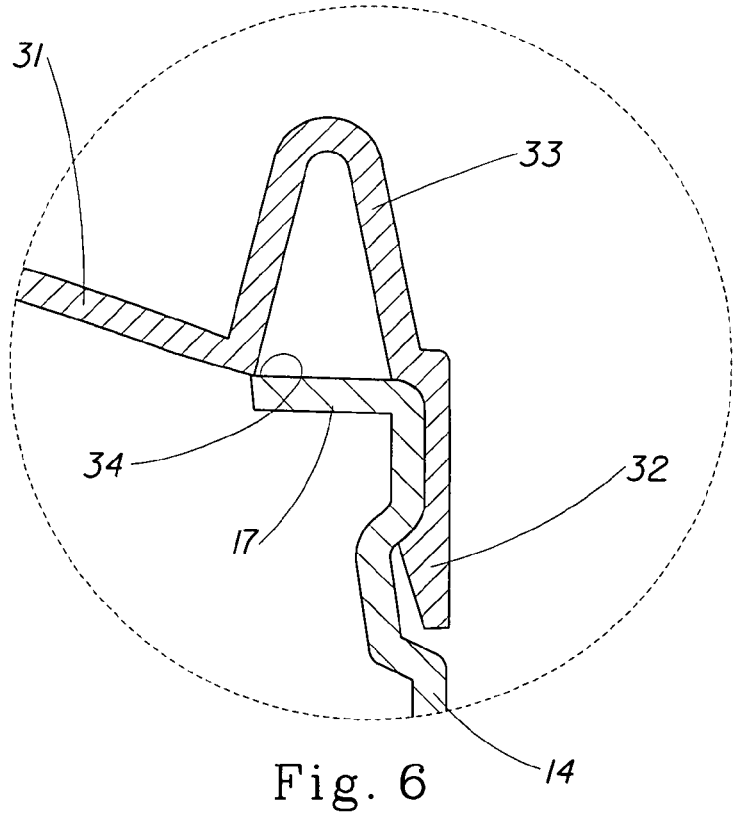
FIG. 6 is an expanded, cross-sectional view of the region labeled 5 in FIG. 4 of the overcap in an expanded position.

As shown in FIG. 5, an exploded view of the region around rib 33, dome portion 31 correspondingly mates with protuberance 17 of container 11. As a non-limiting example, container 11, after opening, requires replacement of overcap 30. A consumer places overcap 30 on container 11 so that an inside edge 34 of rib 33 contacts protuberance 17. A consumer then applies outward pressure on skirt 32 and downward pressure on dome portion 31, expectorating a majority of ambient air entrapped within the headspace of container 11. As shown in FIG. 6, the inside edge 34 of rib 33 then fully seats on protuberance 17, producing a complete seal. In a non-limiting example, protuberance 17 varies from −5° to +5° from a line perpendicular to body 14. Inside edge 34 is designed to provide contact with protuberance 17 for this variation. As another non-limiting example, overall travel of the inside edge 34 of rib 33 has been nominally measured at three millimeters for a protuberance 17 width of four to six millimeters. It has been found that when protuberance 17 is angularly disposed, protuberance 17 forms a sufficient surface to provide for sealing adhesive attachment of closure 18 to protuberance 17.

Additionally, the inside edge 34 of rib 33 can effectively prevent the pollution of protuberance 17, with or without closure 18 in place, thereby providing a better seal. As pressure within container 11 builds due to off gas from the entrained product, dome portion 31 of overcap 30 deflects outward. This outward deflection causes the inside edge 34 of rib 33 to migrate toward the center of container 11 along protuberance 17. This inward movement results in a transfer of force through rib 33 to an inward force on skirt portion 32 to be applied to container wall 14 and the outer portion of protuberance 17, resulting in a strengthened seal. Additionally, significant deflections of dome 31 due to pressurization of closure 18 causes the inside edge 34 to dislocate from protuberance 17 allowing any vented off gas to escape past protuberance 17 to the outside of overcap 30. This alleviates the need for a vent in overcap 30.

As shown in FIG. 9, in an alternative embodiment of overcap 30*b* comprises a plurality of nested cylindrical formations. In other words, in this alternative embodiment, the base of overcap 30*b*, having a diameter, d, forms a base portion 60 upon which the upper portion 62 of overcap 30*b*, having a diameter, d−Δd, is disposed thereon. The upper portion 62 of overcap 30*b* can have an annular protuberance 64 disposed thereon. It is believed that the annular protuberance 64 disposed upon the upper portion 62 of overcap 30*b* can provide a form upon which annular ring 42 disposed upon closed bottom 13, can lockably nest.

In another embodiment, it has been found advantageous to limit Δd. A small Δd can result in the connecting wall 63 of overcap 30*b* being proximate to protuberance 17. Providing a small Δd in this manner can facilitate the transfer of a force exerted by a load disposed upon overcap 30 to an attached container during storage and shipping.

Figure 10:
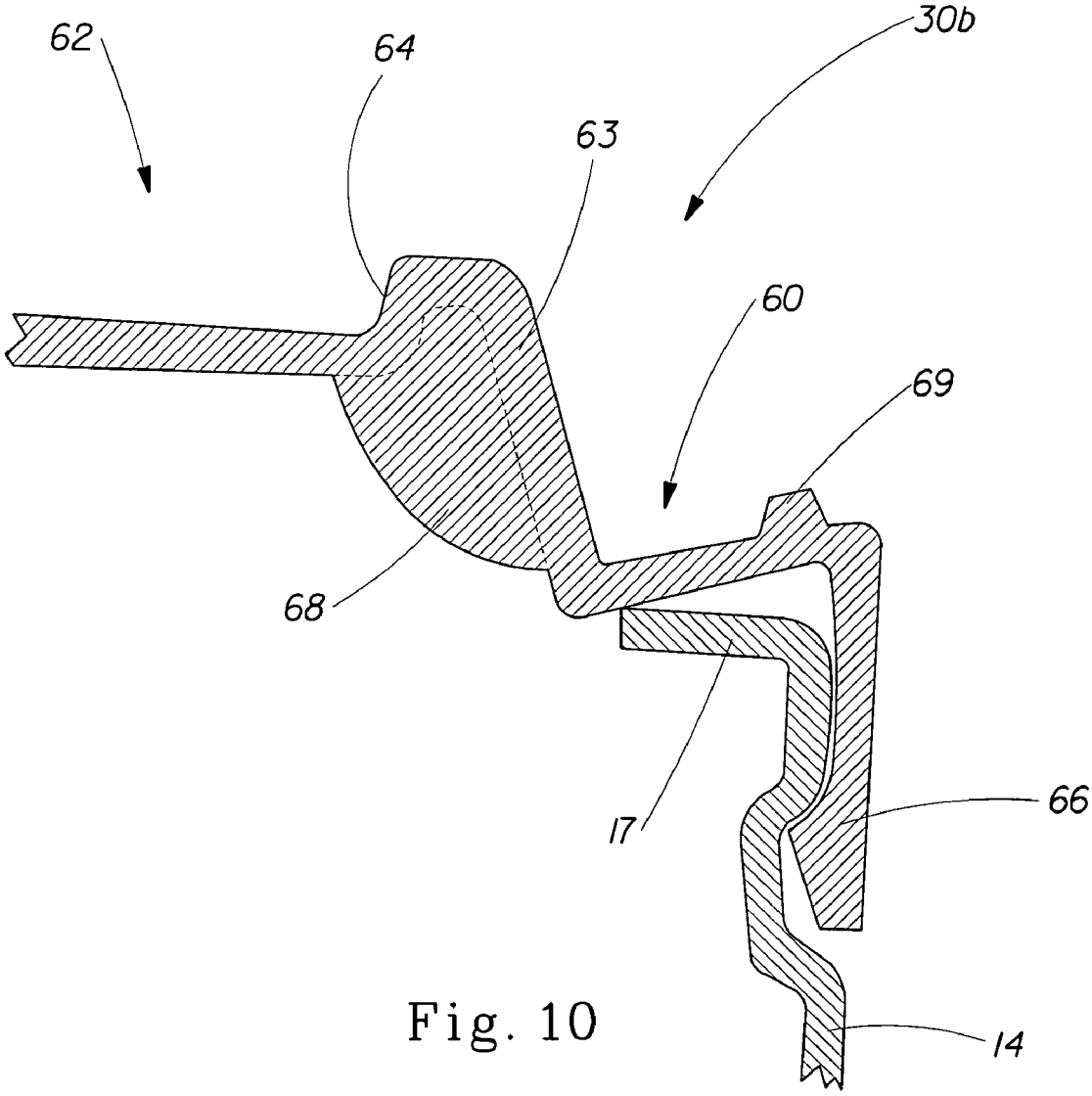
FIG. 10 is a cross-sectional view of the region labeled 10 in FIG. 9 in contact with a fresh packaging system.

As shown in FIGS. 9*a* and 10, in an alternative embodiment, the inner surface of the base portion 60 of overcap 30*b* can have an annular sealing ring 66 disposed thereon. Annular sealing ring 66 was surprisingly found to facilitate the mating of surfaces corresponding to annular sealing ring 66 and the finish portion of container 11. Mating the surfaces in this manner can provide an audible recognition that both surfaces have made contact and that a secure seal between protuberance 17 and the internal surface of overcap 30*b* has been made. A surprising feature of overcap 30*b* is the ability of the end user to "burp" excess atmospheric gas from container 11 thereby reducing the amount of oxygen present. Further, it is believed that an inner surface of base portion 60 mate with at least a portion of protuberance 17 so that there is provided an overlap of the inner surface of base portion 60 with protuberance 17. One of skill in the art would realize that any configuration of the annular sealing ring 66 may be used to provide the facilitation of the corresponding mating surfaces, including, but not limited to, interrupted annular rings, a plurality of protuberances, and combinations thereof. It is also believed that providing a protuberance 69 in the form of an annular ring, plurality of protuberances, and other protuberances known to one of skill in the art, can provide a method of stacking a plurality of overcaps 30*b* prior to overcap 30*b* being applied to a container.

As shown in FIG. 9*a*, it was surprisingly found that a plurality of protuberances 68 disposed upon the inner surface of overcap 30*b* could facilitate the replacement of overcap 30*b* upon container 11. In this manner, it is believed that the plurality of protuberances 68 disposed upon the inner surface of overcap 30*b* can effectively translate the horizontal component of a force applied to overcap 30*b* during replacement of overcap 30*b* upon container 11 through the plurality of protuberances 68 thereby allowing the plurality of protuberances 68 to effectively traverse over the edge of container 11 and ultimately aligning the longitudinal axis of overcap 30*b* with the longitudinal axis of container 11. Further, a plurality of protuberances 68 disposed upon the inner surface of overcap 30*b* can also provide additional structural rigidity to overcap 30*b* and can increase the transfer efficiency of a force exerted by a load disposed upon overcap 30*b* to container 11. It would be realized by one of skill in the art that the plurality of protuberances 68 could comprise a plurality of spherical, semi-spherical, elliptical, quarter-round, and polygonal projections, indentations, and combinations thereof.

In an alternative embodiment as shown in FIG. 13, container 11*f* can be provided with at least one secondary protuberance 74 disposed upon body portion 14. In this way, overcap 30*c* can be provided with an elongate skirt portion 72 with annular sealing ring 66*a* disposed thereon. Thus, annular sealing ring 66*a* can be removeably engaged with secondary protuberance 74 to provide a better engagement of overcap 30*c* to container 11*f*. Without desiring to be bound by theory, it is believed that a container 11*f* provided with a protuberance 17*a* will exhibit a rotational movement about axis 76 due to a vacuum internal to container 11*f* and/or a load disposed upon protuberance 17*a* thereby causing protuberance 17*a* to move away from overcap 30*c*. Thus, providing secondary protuberance 74 along body portion 14 away from axis 76 can provide a point of interaction between overcap 30*c* and container 11*f* that is subject to less movement. Secondary protuberance 74 can be provided as an annular ring, a plurality of individual protuberances or a plurality of collectively elongate protuberances. Elongate skirt portion 72 can be provided as an annular protuberance or a collectively annular plurality of separable segments. Further, elongate skirt portion 72 can be provided in any length to facilitate attachment of overcap 30*c* to secondary protuberance 74 disposed upon body portion 14.

Coffee Packaging

A preferred method of packaging a whole, roast coffee in accordance with the present invention to provide a more freshly packed coffee product, is detailed herein.

A whole coffee bean is preferably blended and conveyed to a roaster, where hot air is utilized to roast the coffee to the desired degree of flavor development. The hot roasted coffee is then air-cooled and subsequently cleaned of extraneous debris.

In a preferred, but non-limiting step, a whole roast coffee is cracked and normalized (blended) before grinding to break up large pieces of chaff. The coffee is then ground and cut to the desired particle size for the grind size being produced. The ground coffee then preferably enters a normalizer that is connected to the bottom of the grinder heads. In the normalizer, ground coffee is preferably slightly mixed, thus, improving the coffee appearance. As another non-limiting step, the coffee discharges from the normalizer and passes over a vibrating screen to remove large pieces of coffee.

The ground coffee is then preferably sent to a filler surge hopper and subsequently to a filling apparatus (filler). The filler weighs a desired amount of coffee into a bucket that in turn, dumps the pre-measured amount of coffee into a container manufactured as detailed supra. The container is then preferably topped-off with an additional amount of coffee to achieve the desired target weight.

The container is then preferably subjected to an inert gas purge to remove ambient oxygen from the container headspace. Non-limiting, but preferred, inert gases are nitrogen, carbon dioxide, and argon. Optionally, an oxygen scavenger, as described supra, and generally present in the form of a packet can be included within the container to provide removal of free or complexed oxygen. A closure, as disclosed supra, is placed on the container to effectively seal the contents from ambient air. Preferably the closure has a one-way valve disposed thereon. An overcap, disclosed supra, is then applied onto the container, effectively covering the closure and locking into the container sidewall ridge. The finished containers are then packed into trays, shrink wrapped, and unitized for shipping.

Freshness

It is believed that the resulting inventive packaging system provides a consumer with a perceptively fresher packed roast and ground coffee that provides a stronger aroma upon opening of the package and the perception of a longer-lasting aroma that is apparent with repeated and sustained openings of the packaging system. Not wishing to be bound by any theory, it is believed that roast and ground coffee elutes gases and oils that are adsorbed onto the polyolefinic compound comprising the inside of the container and closure. Upon removal of the closure, the polyolefinic compound then evolutes these adsorbed gases and oils back into the headspace of the sealed container. It is also believed that the inventive packaging system can also prevent the infiltration of deleterious aromas and flavors into the packaging system. Thus, the construction of the instant packaging system can be altered to provide the benefit of most use for the product disclosed therein. To this end, it is further believed that the packaging system can be utilized for the containment of various products and yet provide the benefits discussed herein.

Applicants characterize the surprising aroma benefits provided by the present article of manufacture in terms of the article's "overall coffee aroma value", which is an absolute characterization. Applicants also characterize the aroma benefits relative to a control article (a prior art metallic can, as described below). Such a characterization is referred to herein as the article's "differential coffee aroma value". The methods for measuring overall coffee aroma value and differential coffee aroma value are described in detail in the Test Method section infra.

The article of manufacture will have an overall coffee aroma value of at least about 5.5. Preferably, the article will have an overall coffee aroma value of least about 6, more preferably at least about 6.5, still more preferably at least about 7, and still more preferably at least about 7.5.

Preferably, the article of manufacture of the present invention will have a differential coffee aroma value of at least about 1.0, more preferably at least about 2.0, and most preferably at least about 2.8.

Test Method

A test container and an existing industry standard metallic container (control container) are packed with identical fresh roast and ground coffee product, prepared as stated above, and stored for 120 days prior to testing. Immediately prior to testing, the containers are emptied and wiped with a paper towel to remove excess roast and ground coffee product. Each container is then capped and let stand prior to testing in order to equilibrate. During testing, each container used is exchanged with another similarly prepared, but, unused container at one-hour intervals. A control container is a standard 603, tin-plated, 3-pound (1.36 Kg), vacuum-packed, steel can.

Individual panelists are screened for their ability to discriminate odors utilizing various standard sensory methodologies as part of their sensory screening. Panelists are assessed for aroma discriminatory ability using the gross olfactory acuity-screening test (universal version) as developed by Sensonics, Inc., for aroma. This test method involves a potential panelist successfully identifying aromas in a "scratch and sniff" context.

Forty successful, qualified panelists are then blindfolded and each evaluates a test container and a control container. Each blindfolded panelist smells a first container (either test container or control container) and rates the aroma on a 1 to 9 point scale (integers only) with reference to the following description: no aroma (1) to a lot of aroma (9). After a brief relief period, the blindfolded panelist evaluates the second container. The range for overall aroma is again assessed by panelists using the same rating system.

The panel results for overall coffee aroma value are then tabulated and statistically evaluated. Standard deviations based on a Student T statistical test are calculated with 95% confidence intervals to note where statistically significant differences occur between the mean values of the two products tested. Exemplary and statistically adjusted results of a "blind test" panel using existing packaging methodologies for roast and ground coffee are tabulated in Table 3, as follows:

TABLE 3

Roast and Ground Coffee Sensory Panel Results for Comparing Inventive Articles vs. Existing Articles at 120 days at 70° F. (21° C.)

| | Inventive Package (Plastic) | Standard Steel Package (Control) |
|---|---|---|
| No. Respondents | 40 | 40 |
| Amount of Coffee Aroma | 7.3 | 4.5 |

Based upon this test panel, it was surprisingly found that the present articles of manufacture provide a perceived "fresher" roast and ground coffee end product for a consumer. The improvement in overall coffee aroma was increased from the control sample adjusted panel value of 4.5 to an adjusted panel value of 7.3 for the inventive article, resulting in a differential adjusted value of 2.8.

While particular embodiments of the present invention have been illustrated and described, it will be obvious to those skilled in the art that various changes and modifications may be made without departing from the spirit and scope of the invention. One skilled in the art will also be able to recognize that the scope of the invention also encompasses interchanging various features of the embodiments illustrated and described above. Accordingly, the appended claims are intended to cover all such modifications that are within the scope of the invention.

What is claimed is:

1. A packaging system comprising:

a blow-molded container comprising a longitudinal axis, said blow-molded container further comprising a closed bottom, an open top, and a body having an enclosed perimeter between said bottom and said top;

wherein said bottom, top, and body together define an interior volume wherein said body has at least one region of deflection disposed thereon, and wherein said region of deflection allows flexion and thereby has less resistance to flexing than the body of said container proximate to said region of deflection;

an outwardly facing annular protuberance disposed upon said body, said annular protuberance being continuously disposed around said perimeter of said body proximate to said top wherein said protuberance forms a surface external to said body, said surface being substantially perpendicular to said longitudinal axis; and, a flexible closure removably attached and sealed to said annular protuberance;

wherein coffee is contained within said packaging system.

2. The packaging system of claim 1 wherein said flexible closure comprises a laminate structure, said laminate structure comprising at least one barrier layer.

3. The packaging system of claim 2 wherein said laminate further comprises a foil.

4. The packaging system of claim 1 wherein said flexible closure has a one-way valve disposed thereon.

5. The packaging system of claim 1 wherein said blow-molded container comprises a material selected from the group consisting of polycarbonate, linear low density polyethylene, low density polyethylene, high density polyethylene, polyethylene terephthalate, polypropylene, polystyrene, polyvinyl chloride, co-polymers thereof, and combinations thereof.

6. The packaging system of claim 5 wherein said material is a multi-layered structure.

7. The packaging system of claim 6 wherein said multi-layered structure further comprises at least one oxygen barrier layer.

8. The packaging system of claim 1 wherein said body has a handle disposed thereon.

9. The packaging system of claim 8 wherein said handle is integral with said body.

10. The packaging system of claim 8 wherein said handle is substantially parallel to said longitudinal axis of said container.

11. The packaging system of claim 1 further comprising an overcap.

12. The packaging system of claim 11 wherein said overcap is constructed from a material selected from the group consisting of polycarbonate, linear low density polyethylene, low density polyethylene, high density polyethylene, polyethylene terephthalate, polypropylene, polystyrene, polyvinyl chloride, co-polymers thereof, and combinations thereof.

13. The packaging system of claim 11 wherein said overcap further comprises a first protuberance disposed upon said overcap, said protuberance being mateingly engageable with a second protuberance disposed upon said body of said container, wherein said overcap is releasably attached to said container upon the mating engagement of said first and second protuberances.

14. The packaging system of claim 11, wherein said overcap comprises a dome portion, said dome portion comprising a first surface, said first surface having at least one protuberance disposed thereon.

15. The packaging system of claim 1 wherein said coffee is roast and ground.

16. The packaging system of claim 1, wherein said closed bottom of said container is concave inwardly.

17. A packaging system comprising:

a blow-molded container comprising a longitudinal axis, said blow-molded container further comprising a closed bottom, an open top, and a body having an enclosed perimeter between said bottom and said top;

wherein said bottom, top, and body together define an interior volume, wherein said body has at least one region of deflection disposed thereon, and wherein said region of deflection allows flexion and thereby has less resistance to flexing than the body of said container proximate to said region of deflection;

an outwardly facing annular protuberance disposed upon said body, said annular protuberance being continuously disposed around the perimeter of said body proximate to said top wherein said protuberance forms a surface external to said body, said surface being substantially perpendicular to said longitudinal axis; and a flexible closure removably attached and sealed to said annular protuberance;

wherein said annular protuberance translates the force of a load of at least about 16 pounds disposed upon said packaging system in a direction substantially parallel to said longitudinal axis and wherein coffee is contained within said packaging system.

18. The packaging system of claim 17 wherein said blow-molded container is manufactured from a material having a tensile modulus ranging from at least about 35,000 pounds per square inch (2,381 atm) to at least about 650,000 pounds per square inch (4,230 atm).

* * * * *

UNITED STATES PATENT AND TRADEMARK OFFICE

CERTIFICATE OF CORRECTION

PATENT NO. : 7,169,419 B2
APPLICATION NO. : 10/726309
DATED : January 30, 2007
INVENTOR(S) : Dalton et al.

It is certified that error appears in the above-identified patent and that said Letters Patent is hereby corrected as shown below:

Column 20

Line 23, delete "4,230" and insert -- 44,230 --.

Signed and Sealed this

Seventeenth Day of June, 2008

JON W. DUDAS
*Director of the United States Patent and Trademark Office*